US008042895B2

(12) United States Patent
McCracken et al.

(10) Patent No.: US 8,042,895 B2
(45) Date of Patent: Oct. 25, 2011

(54) INK CONDUCTIVITY RECOVERY METHOD FOR AN IMAGING DEVICE

(75) Inventors: Ivan Andrew McCracken, Portland, OR (US); Michael Kenneth Oehl, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 512 days.

(21) Appl. No.: 12/262,530

(22) Filed: Oct. 31, 2008

(65) Prior Publication Data

US 2010/0110117 A1 May 6, 2010

(51) Int. Cl.
*B41J 29/38* (2006.01)

(52) U.S. Cl. ..... 347/6; 347/85; 347/87

(58) Field of Classification Search ..... 347/6, 85–88
See application file for complete search history.

(56) References Cited

U.S. PATENT DOCUMENTS 3,963,979 A * 6/1976 Dauphinee ..... 324/444
6,102,517 A * 8/2000 Kobayashi et al. ..... 347/23
6,494,553 B1 12/2002 Donahue et al.
6,575,096 B1 6/2003 Caruthers et al.
2007/0076023 A1 4/2007 Knierim et al.
2007/0252879 A1* 11/2007 Banning et al. ..... 347/99
2010/0079512 A1* 4/2010 McCracken et al. ..... 347/7

* cited by examiner

*Primary Examiner* — Ellen Kim
(74) *Attorney, Agent, or Firm* — Maginot, Moore & Beck LLP

(57) ABSTRACT

A method for restoring ink conductivity of ink in an ink reservoir comprises detecting an ink conductivity of an ink volume in an ink reservoir, and comparing the detected ink conductivity to a predetermined ink conductivity operational range. A flush routine is performed in response to the measured ink conductivity being outside of the predetermined ink conductivity operational range. The flush routine includes: disabling ink supply operations to the ink reservoir; emptying the ink reservoir of ink; refilling the ink reservoir with ink; measuring an ink conductivity of an ink volume in the refilled ink reservoir; and comparing the detected ink conductivity to the predetermined ink conductivity operational range. The imaging device is returned to a normal operating mode in response to the measured ink conductivity being within the predetermined ink conductivity operational range after a flush routine has been performed.

20 Claims, 17 Drawing Sheets

INK CONDUCTIVITY RECOVERY METHOD FOR AN IMAGING DEVICE

TECHNICAL FIELD

This disclosure relates generally to ink jet printers, and in particular, to maintenance methods for use with such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a melt reservoir. The melt reservoir is configured to maintain a quantity of melted ink in liquid or melted form and to communicate the melted ink to one or more printheads as needed.

In order to prevent the ink storage and supply assembly of the imaging device from exhausting the available supply of ink, the reservoirs of the ink storage and supply assembly may be provided with ink level sensors. Recently, ink level sensors have been developed that enable a continuous measurement of the level of ink in the reservoirs of the printer. These ink level sensors include a lower probe positioned near a lower portion of the reservoir, an upper probe that extends upward form the lower probe toward the top of the reservoir, and an outer probe. To detect the level of ink in an ink reservoir, an AC signal is driven to the outer probe. The ink in the reservoir conducts the AC signal to the lower probe and to the upper probe. A current flow is detected from the outer probe through the ink to the lower probe and from the outer probe through the ink to the upper probe. Assuming that the ink temperature and conductivity remains relatively consistent, a substantially constant current flow is detected via the lower probe. Varying levels of current flow are detected via the upper probe as more or less of the upper probe's surface area is covered or uncovered in ink. A continuous measurement of the height of ink in the ink reservoir may then be determined by comparing the varying current flow in the upper probe to the constant current flow in the lower probe.

The ink level sensor described above is robust to variation in ink conductivity that may result due to normal variation in the manufacturing processes of the ink and/or due to natural variation in the ink components. For example, due to variation inherent in the manufacture of ink from raw components, a moderate variation in the conductivity of the ink may be expected from batch to batch and accounted for accordingly. However, if ink having a conductivity that exceeds the range of reliable operation of a level sensor enters the reservoir, the level readings generated by the level sensor for that reservoir may not be accurate or the level sensor may fail altogether resulting in various printhead failures, including introduction of air which causes jetting failure, and weeping of jets which can contaminate the drum.

SUMMARY

In response to the difficulties posed due to ink conductivity variations, an ink recovery operation mode has been developed that enables the restoration of ink conductivity of a reservoir ink volume to a nominal range of operational conductivity in response to the ink conductivity being outside of the nominal range. In one embodiment, a method for restoring ink conductivity of ink in an ink reservoir comprises detecting an ink conductivity of an ink volume in an ink reservoir, and comparing the detected ink conductivity to a predetermined ink conductivity operational range. A flush routine is performed in response to the measured ink conductivity being outside of the predetermined ink conductivity operational range. The flush routine includes: disabling ink supply operations to the ink reservoir; emptying the ink reservoir of ink; refilling the ink reservoir with ink; measuring an ink conductivity of an ink volume in the refilled ink reservoir; and comparing the detected ink conductivity to the predetermined ink conductivity operational range. The imaging device is returned to a normal operating mode in response to the measured ink conductivity being within the predetermined ink conductivity operational range after a flush routine has been performed.

In another embodiment, a system for use with an imaging device comprises an ink conductivity sensor positioned in an ink reservoir of an imaging device. The ink conductivity sensor is configured to generate a signal indicative of an ink conductivity of a volume of ink in the ink reservoir. The system includes a controller configured to receive the signal from the ink conductivity sensor and to compare the ink conductivity indicated by the signal to a predetermined ink conductivity operational range. The controller is configured to implement a flush routine in response to the ink conductivity being outside of the predetermined ink conductivity operational range. The flush routine includes disabling print operations of the imaging device and ink supply operations to the ink reservoir; purging ink through the at least one printhead until the ink reservoir is empty of ink; enabling the ink supply to refill the emptied ink reservoir with an ink volume; detecting an ink conductivity of an ink volume in the refilled ink reservoir; and comparing the detected ink conductivity to a predetermined ink conductivity operational range. In response to the detected ink conductivity being within the predetermined ink conductivity operational range after a flush routine has been performed, the controller is configured to return the imaging device to normal operating mode.

In yet another embodiment, a method of operating an imaging device comprises measuring an ink conductivity of an ink volume in an ink reservoir of an imaging device. The ink reservoir is configured to receive ink from an ink supply and to deliver the received ink to at least one printhead of the imaging device. The measured ink conductivity is compared to a predetermined ink conductivity operational range. Print operations of the imaging device and ink supply operations to the ink reservoir are disabled in response to the measured ink conductivity being outside of the predetermined ink conductivity operational range. Ink is then purged through the at least one printhead until the printhead is empty of ink. The printhead is then refilled with ink from the ink reservoir. The purging and refilling steps are repeated until the ink reservoir is empty of ink. Ink supply operations to the ink reservoir from the ink supply are then enabled to refill the ink reservoir in response to the ink reservoir being emptied. An ink conductivity of an ink volume in the refilled ink reservoir is measured and compared to the predetermined ink conductivity operational range. Print operations are enabled in response to the measured ink conductivity being within the predetermined ink conductivity operational after the ink reservoir has been refilled. This process may be repeated several times depending on the measured results.

DETAILED DESCRIPTION OF THE PREFERRED EMBODIMENT

Figure 1:
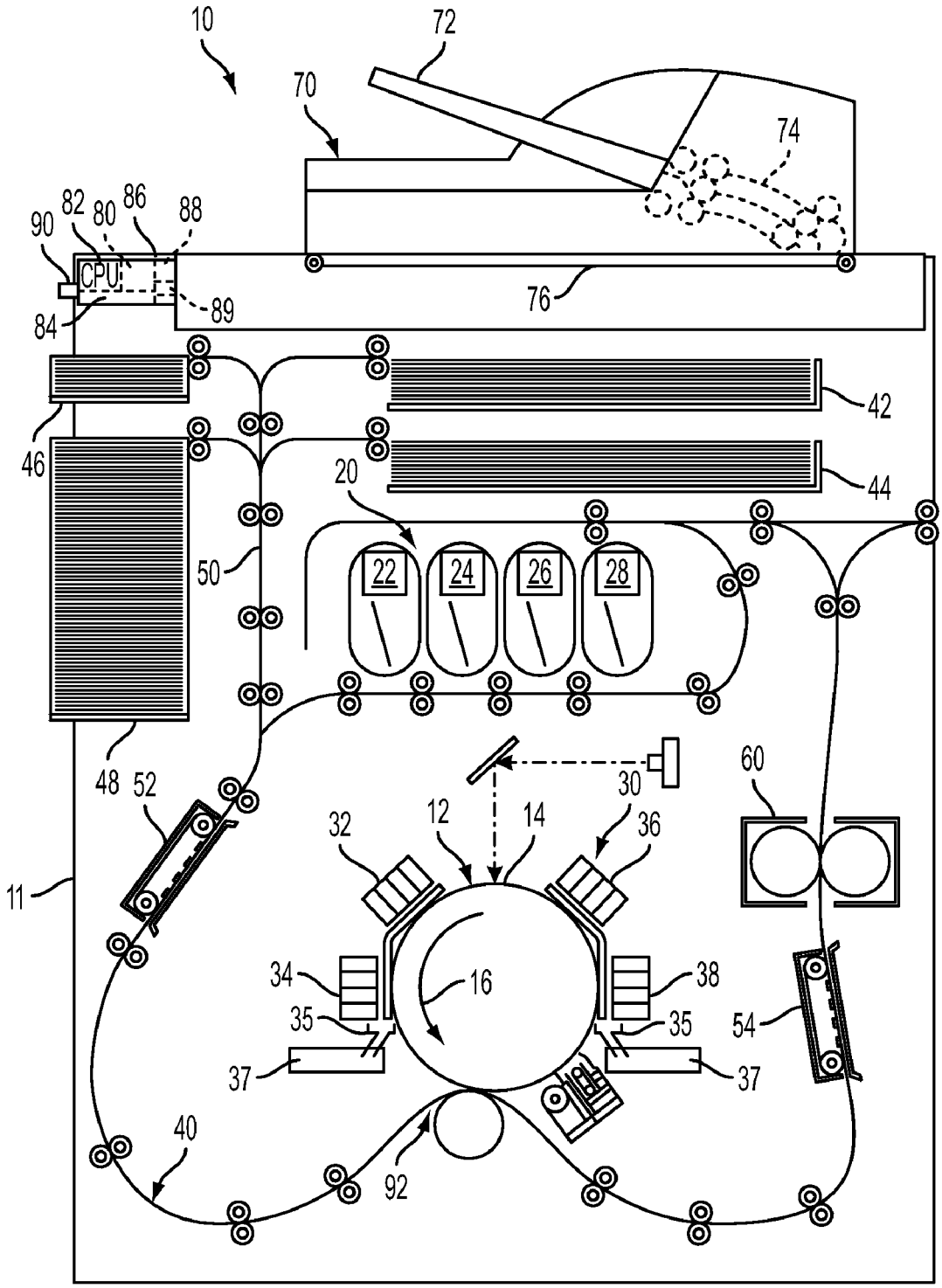
FIG. 1 is block diagram of a phase change ink image producing machine.

For a general understanding of the system disclosed herein as well as the details for the system and method, reference is made to the drawings. In the drawings, like reference numerals have been used throughout to designate like elements. As used herein, the word "printer," "imaging device," "image producing machine," etc. encompasses any apparatus that performs a print outputting function for any purpose, such as a digital copier, bookmaking machine, facsimile machine, a multi-function machine, etc.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes for example four (4) sources 22, 24, 26, 28, representing four (4) different colors CYMK (cyan, yellow, magenta, black) of phase change inks. The phase change ink system 20 also includes a phase change ink melting and control assembly 100 (FIG. 2), for melting or phase changing the solid form of the phase change ink into a liquid form. Thereafter, the phase change ink melting and control assembly 100 then controls and supplies the molten liquid form of the ink towards a printhead system 30 including at least one printhead assembly 32. Since the phase change ink image producing machine or printer 10 is a high-speed, or high throughput, multicolor image producing machine, the printhead system includes for example four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

The printer 10 may include a maintenance system for periodically performing a maintenance procedure on the printhead assembly. Maintenance procedures typically include purging ink through the print head, and wiping the faces of the printheads to remove ink and debris. The purging of ink through the printheads of the printhead assembly may be accomplished in any suitable manner as known in the art. The wiping of the printheads may be performed using at least one wiper blade (not shown) as is known in the art that is moved relative to the nozzle plates of the printheads to remove ink residue, as well as any paper, dust or other debris that has collected on the nozzle plate. As seen in FIG. 1, the maintenance assembly may include gutter assemblies 35 for collecting and guiding purged or wiped ink into one or more waste ink trays 37.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Figure 2:
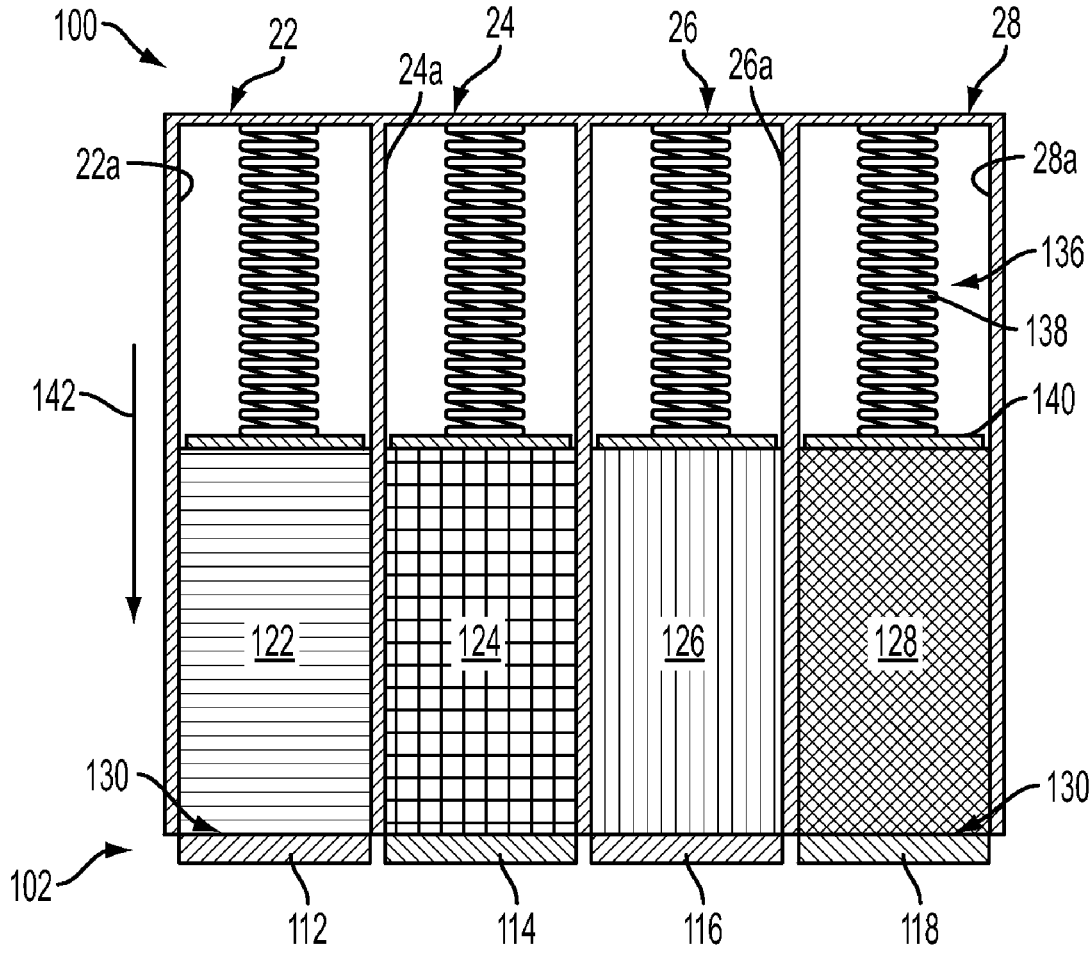
FIG. 2 is top view of four ink sources and a melter assembly having four melter plates of the phase change ink image producing machine of FIG. 1.
Figure 3:
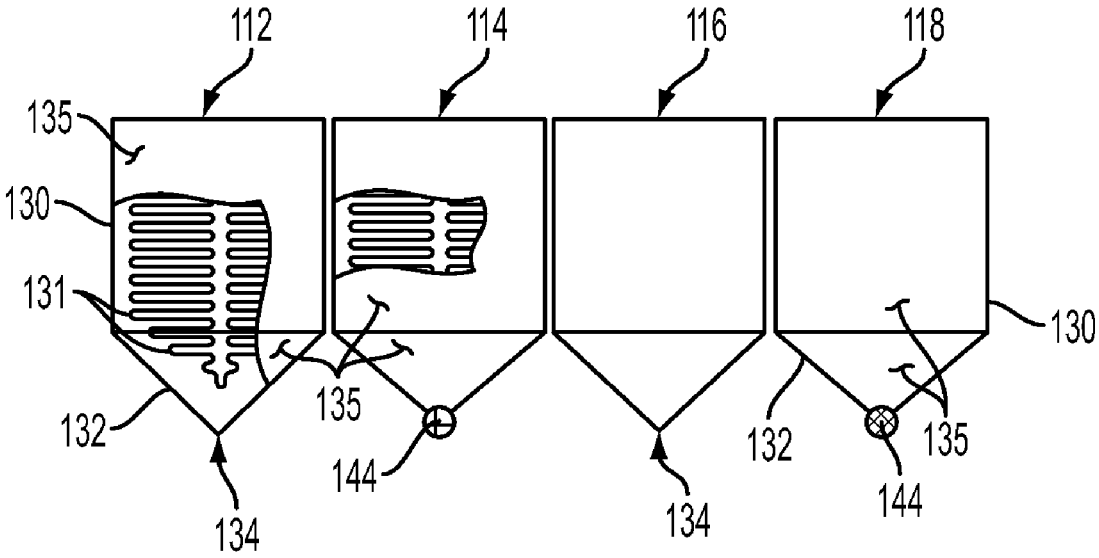
FIG. 3 is front side view of the four melter plates of the melter assembly.

Referring now to FIGS. 2 and 3, there is shown the ink delivery system 100. The ink delivery system 100 of the present example includes four ink sources 22, 24, 26, 28, each holding a different phase change ink in solid form, such as for example inks of different colors. However, the ink delivery system 100 may include any suitable number of ink sources, each capable of holding a different phase change ink in solid form. The different solid inks are referred to herein by their colors as CYMK, including cyan 122, yellow 124, magenta 126, and black 128. Each ink source can include a housing (not shown) for storing each solid ink separately from the others. The solid inks are typically in block form, though the solid phase change ink may be in other formats, including but not limited to, pellets and granules, among others.

The ink delivery system 100 includes a melter assembly, shown generally at 102. The melter assembly 102 includes a melter, such as a melter plate, connected to the ink source for melting the solid phase change ink into the liquid phase. In the example provided herein, the melter assembly 102 includes four melter plates, 112, 114, 116, 118 each corresponding to a separate ink source 22, 24, 26 and 28 respectively, and connected thereto. As shown in FIG. 3, each melter plate 112, 114, 116, 118 includes an ink contact portion 130 and a drip point portion 132 extending below the ink contact portion and terminating in a drip point 134 at the lowest end. The drip point portion 132 can be a narrowing portion terminating in the drip point.

The melter plates 112, 114, 116, 118 can be formed of a thermally conductive material, such as metal, among others, that is heated in a known manner. In one embodiment, solid phase change ink is heated to about 100° C. to 140° C. to melt the phase change ink to liquid form for supplying to the liquid ink storage and supply assembly 400. As each color ink melts, the ink adheres to its corresponding melter plate 112, 114, 116 118, and gravity moves the liquid ink down to the drip point 134 which is disposed lower than the contact portion. The liquid phase change ink then drips from the drip point 134 in drops shown at 144. The melted ink from the melters may be directed gravitationally or by other means to the ink storage and supply assembly 400.

Figure 4:
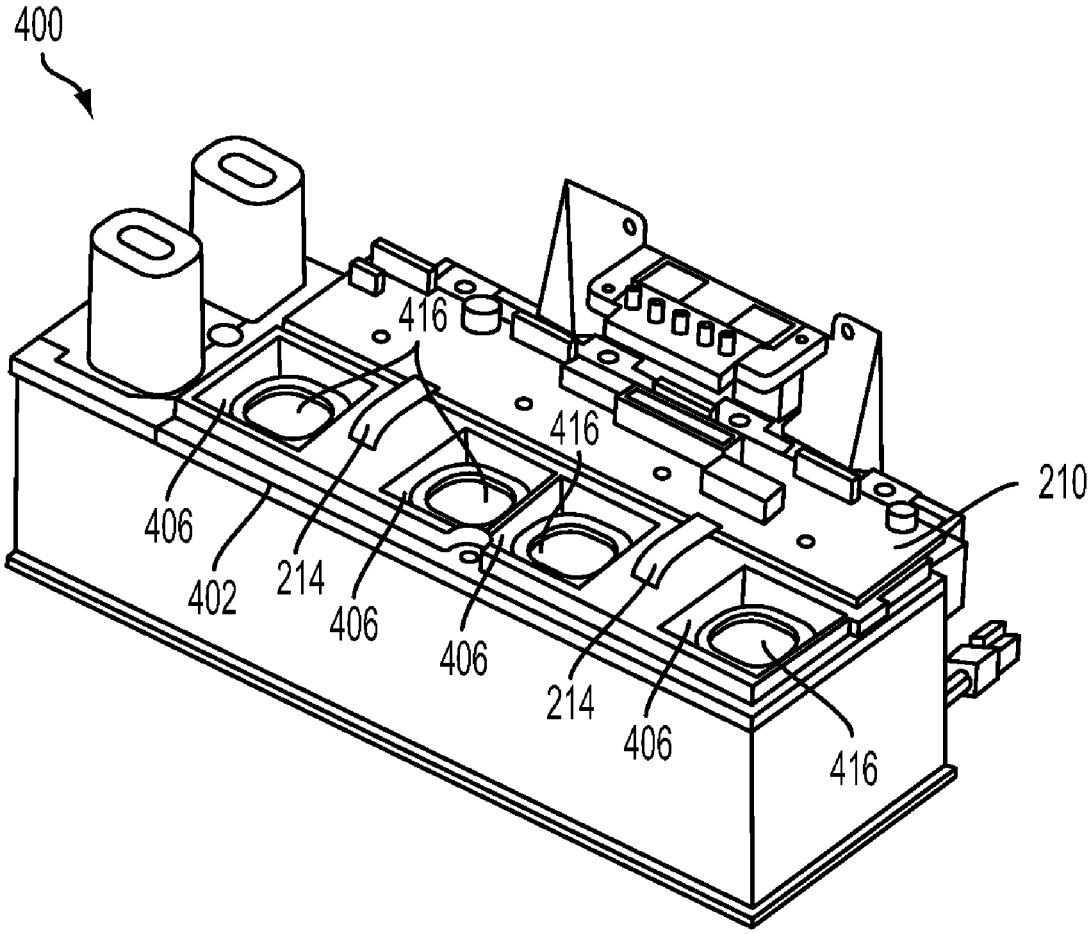
FIG. 4 is a perspective view of an ink storage and supply assembly.
Figure 5:
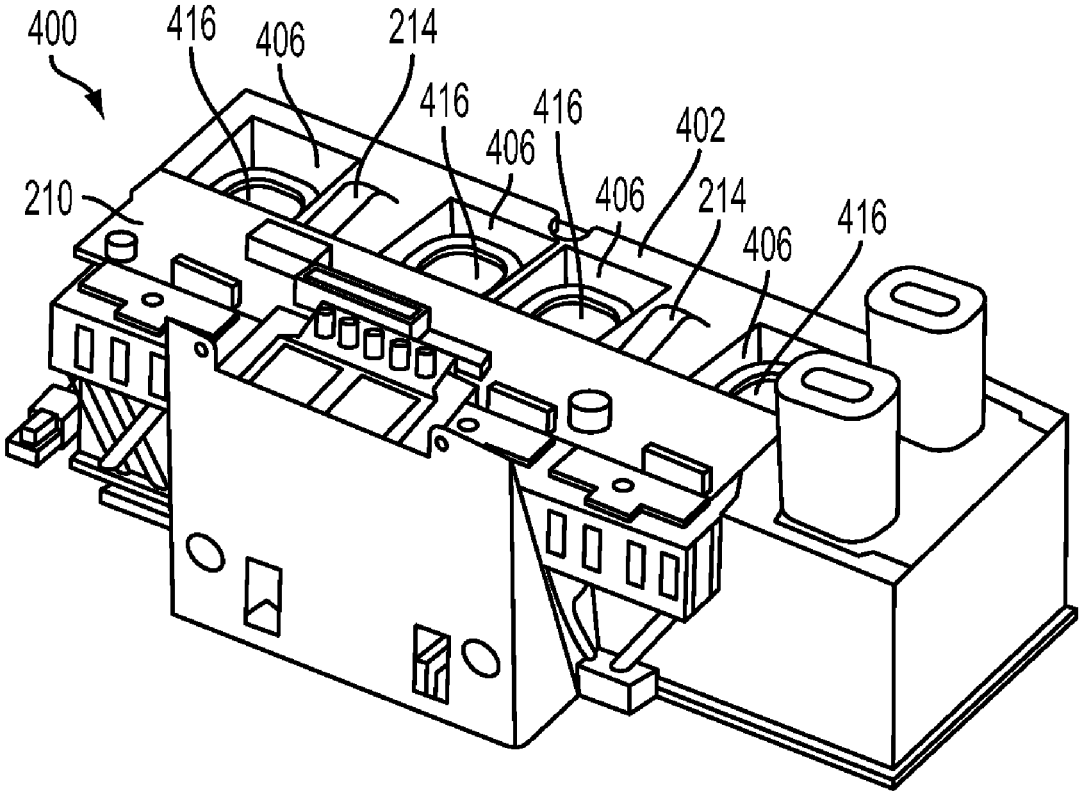
FIG. 5 is another perspective view of the ink storage and supply assembly of FIG. 4.

FIGS. 4 and 5 show front and back perspective views of an embodiment of an ink storage and supply system 400. In the embodiment of FIGS. 4 and 5, the ink storage and supply system 400 includes an ink collector 402 positioned above the primary reservoirs (not shown in FIGS. 4 and 5) of the ink storage and supply system 400. The ink collector 402 includes an opening 406 positioned above each reservoir of the ink storage and supply system 400 that is configured to collect the molten ink as it drips from an ink melter and to direct or funnel the ink into a corresponding reservoir. In some embodiments, the ink collector may also include filters 416 positioned in each opening 406 of the collector that are configured to filter or remove gross contaminants from the ink before the ink enters the reservoirs.

Figure 6:
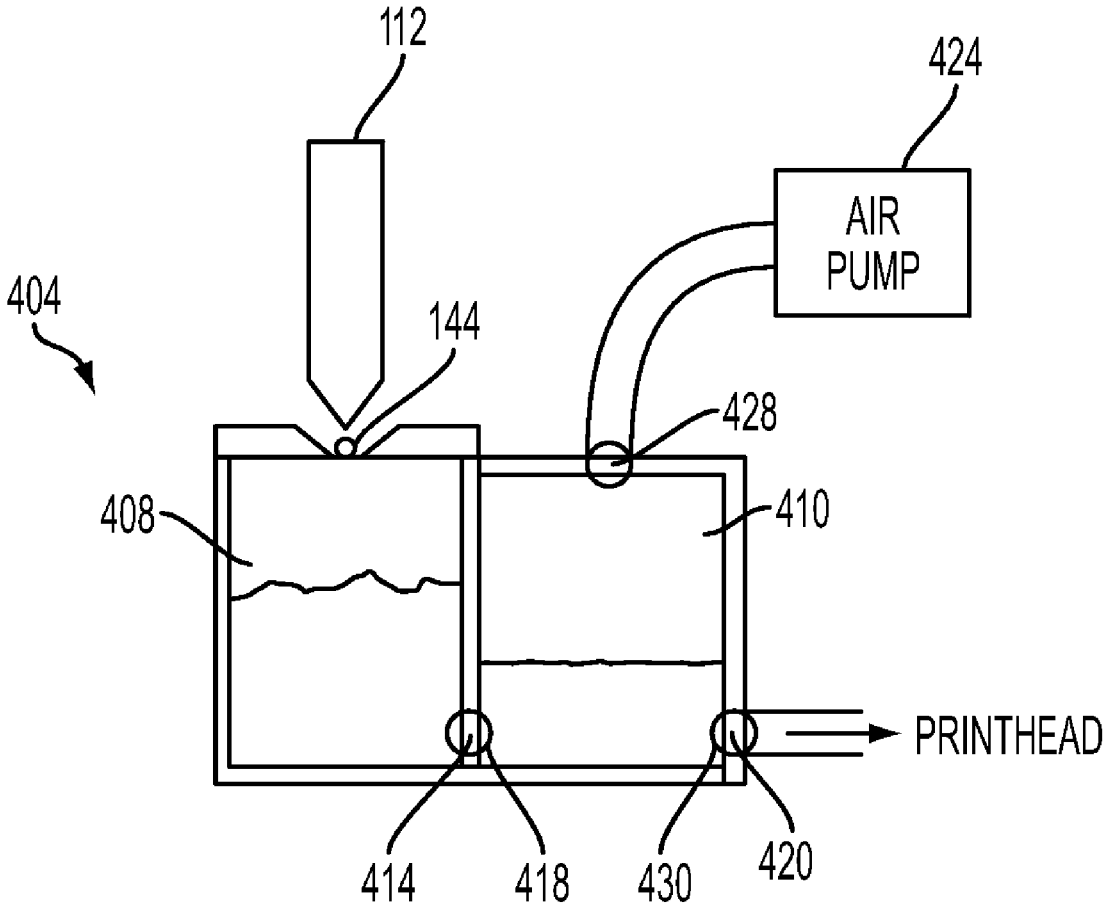
FIG. 6 is a side cross-sectional view of a dual reservoir of the ink melting and control assembly.

In one embodiment, the ink storage and supply system 400 may incorporate a dual reservoir system. FIG. 6 shows a simplified side cross-sectional view of the ink storage and supply system showing an exemplary embodiment of a dual reservoir. In this embodiment, each reservoir 404 of the ink storage and control assembly 400 includes a primary reservoir 408 and a secondary reservoir 410 for each ink source and corresponding ink melter of the ink delivery system. Only one dual reservoir is shown in FIG. 6, but each reservoir 404 of the ink storage and control assembly 400 may be configured as a dual reservoir as depicted in FIG. 6. In the embodiment of FIG. 6, each primary reservoir 408 comprises a low pressure reservoir (LPR) configured to receive molten ink from a corresponding ink melt plate (for example, melt plate 112) of the ink delivery system. Each LPR 408 includes an opening 414 at or near a bottom portion of the LPR 408 through which ink may flow to a corresponding secondary reservoir 410. Gravity, or liquid ink height, may serve as the driving force for causing the molten ink to exit a respective LPR 408 through the opening and into the corresponding secondary reservoir 410. To prevent backflow of ink from a secondary reservoir 410 to the corresponding primary reservoir (LPR) 408, the openings 414 in the LPR's may be provided with one-way check valves 418 that permit ink to flow gravitationally from the LPR 408 into the secondary reservoir 410.

The secondary reservoirs 410 comprise high pressure reservoirs (HPR). Each HPR 410 includes at least one discharge outlet 420 through which molten ink may flow to an ink routing assembly (not shown) for directing ink to one or more printheads (not shown) of the printhead assembly. Each HPR may include a plurality of discharge outlets 420 for supplying ink to a plurality of printheads. For example, in a system that includes four printheads for each color of ink, each HPR may include four discharge outlets, each outlet being configured to supply ink to a different printhead. When charging a printhead with ink, pressure is applied to the ink in a corresponding HPR using, for example, an air pump 424 through a dosing valve 428 or other suitable pressurization means to causing the ink to discharge through the one or more discharge outlets 420 of the HPR. The discharge outlet(s) of the HPR may include check valve(s) 430 or other suitable backflow prevention means that are configured to open to permit the flow of molten ink from the secondary reservoir to the printhead when the HPR is pressurized while preventing backflow of the ink through the opening 420 back into the HPR 410. In addition, the valve 418 in the opening 414 is configured to prevent backflow of ink from the secondary reservoir to the primary reservoir when the secondary reservoir is pressurized.

Figure 7:
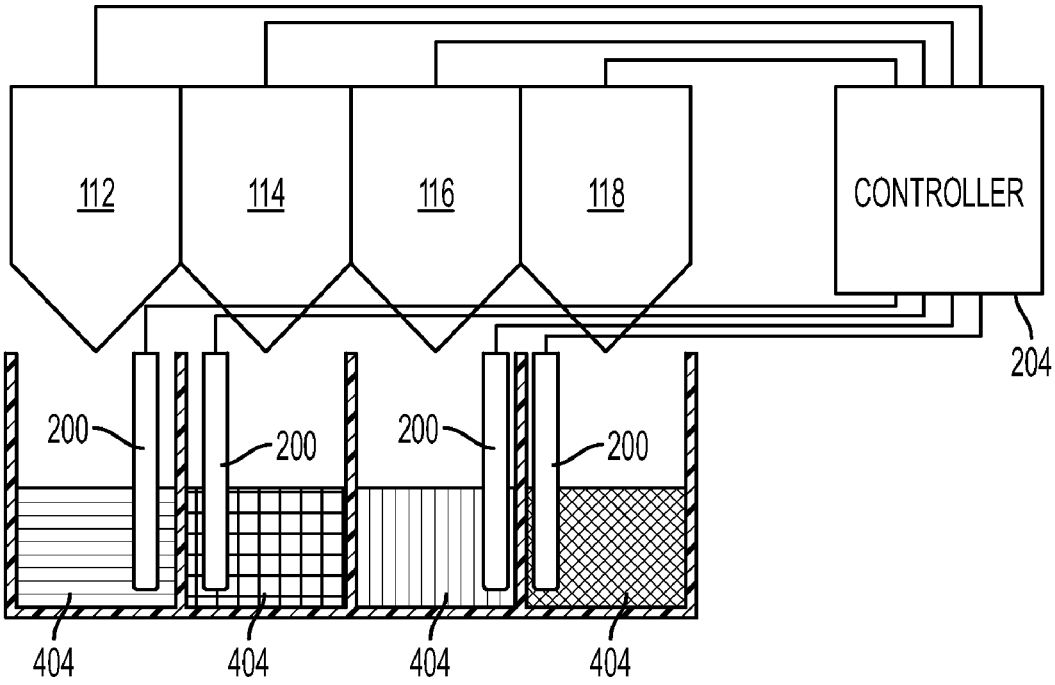
FIG. 7 is a front cross-sectional view of an ink level sensing system.

In order to prevent the ink storage and supply assembly 400 of the imaging device from exhausting the available supply of ink, the reservoirs 404 of the ink storage and supply assembly 400 may be provided with ink level sensors 200. FIG. 7 shows a schematic diagram an exemplary reservoir ink level sensing system for use with the ink storage and supply system 400. As depicted in FIG. 7, the ink level sensing system includes an ink level sensor 200 positioned in each reservoir 404 of the ink storage and supply system 400 and an ink level controller 204. The level sensors 200 are configured to generate one or more signals indicative of the ink level in the corresponding ink reservoir. The ink level controller 204 is configured to receive the signals indicative of the ink levels in each of the reservoirs.

During operation, the ink level controller 204 is configured to maintain a substantially consistent amount of melted ink in the reservoirs available for delivery to the printheads. Accordingly, during operations, the controller 204 is configured to monitor the ink level sensors 200 to determine when the ink level of a reservoir reaches one or more predetermined threshold levels. For example, when a level sensor 200 indicates that the ink level in a reservoir has fallen below a "start fill" level, the controller is configured to signal the corresponding ink melter 112, 114, 116, 118 to begin melting and supplying ink to the ink reservoir. The controller 204 is configured to monitor the ink level sensor in the reservoir as the melted ink is being supplied to the reservoir to determine when a "stop fill" level is reached at which point the controller is configured to signal the appropriate melter to stop supplying ink to the reservoir. Detecting an ink supply deficiency, melting the solid ink in response to the deficiency, and refilling the reservoir to a supply level with the melted ink may be referred to as an "ink melt duty cycle." In addition to the start fill and stop fill levels, the controller is configured to monitor the ink levels as the reservoir is being filled to determine when a "last dose" level is reached at which point the controller may pause operations until the reservoir has been replenished. The last dose level corresponds to the level of ink at which continued printing operations run the risk of running the reservoir dry.

The ink level sensors 200 of the present embodiment are configured to measure the level of ink in each of the reservoirs 404 in a substantially continuous manner. As explained in more detail below, the ink level sensors of the present disclosure are configured to sense or detect the height of ink in a reservoir by detecting or measuring a base line conductivity of the ink present in the reservoir with a lower probe 248, shown in FIGS. 12-15, positioned in a lower portion of a reservoir. An upper probe 246, also shown in FIGS. 12-15, extends upward from the lower probe 248 in the reservoir and is configured to detect or measure the conductivity of the ink in the reservoir as the ink height changes and the upper probe 246 becomes covered or uncovered by ink. The ink level in a reservoir is determined by comparing the base line conductance of the ink in a reservoir indicated by the lower probe 246 to the varying conductance of the ink in the reservoir indicated by the upper probe 248.

Figure 8:
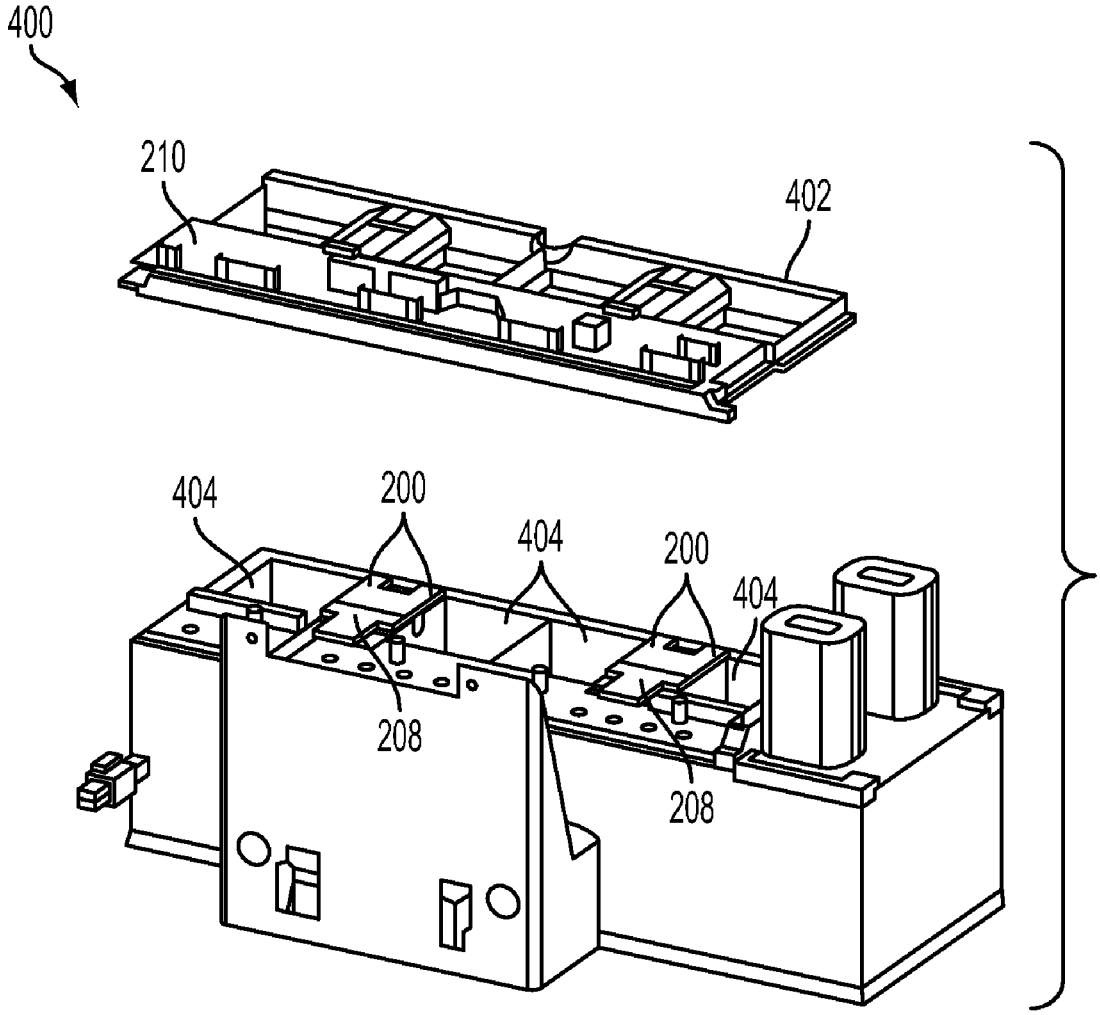
FIG. 8 is a perspective view of the ink storage and supply assembly with the cover removed showing the ink level sensors in the reservoirs.
Figure 9:
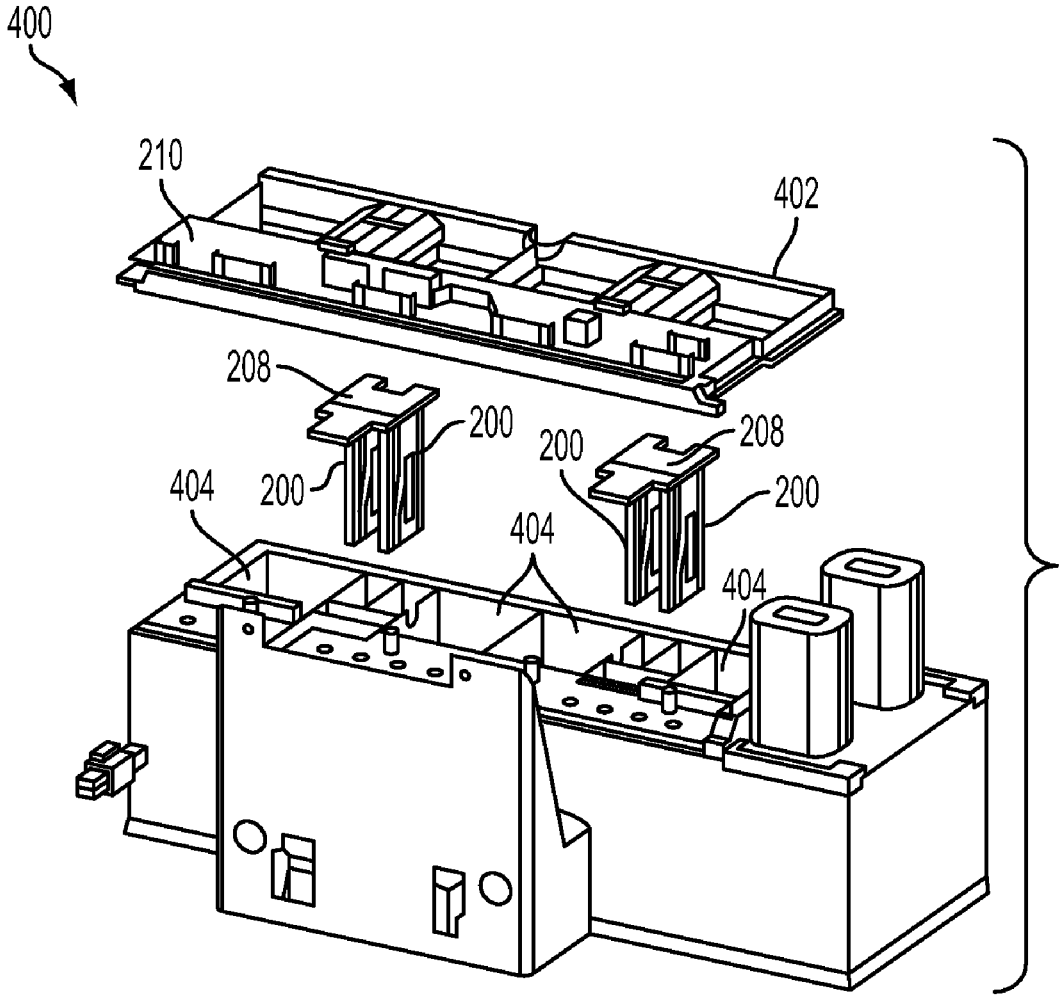
FIG. 9 is a perspective view of the ink storage and supply assembly with the cover removed showing the ink level sensors out of the reservoirs.
Figure 10:
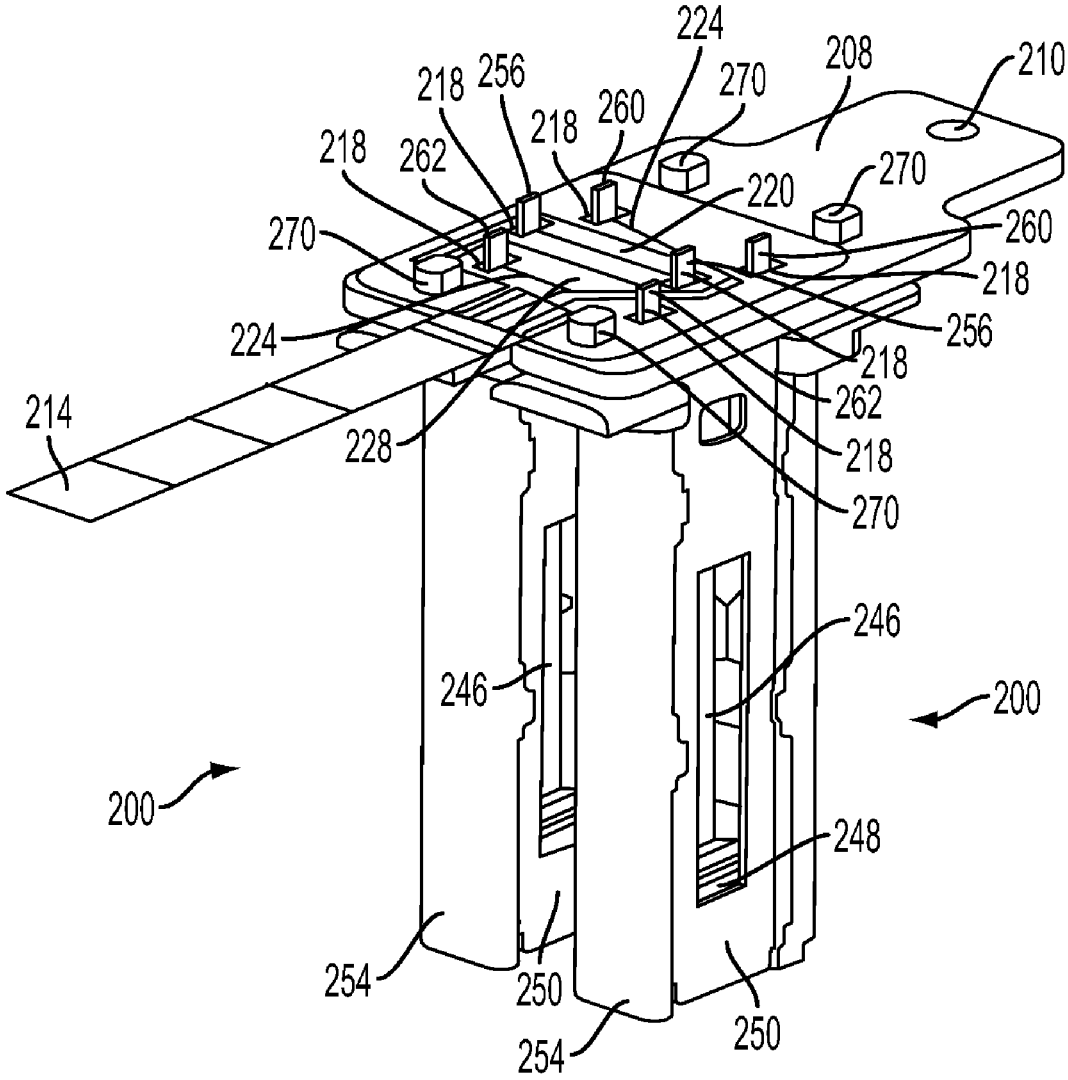
FIG. 10 is a perspective view of a pair of level sensors and the corresponding sensor support and flex cable.
Figure 11:
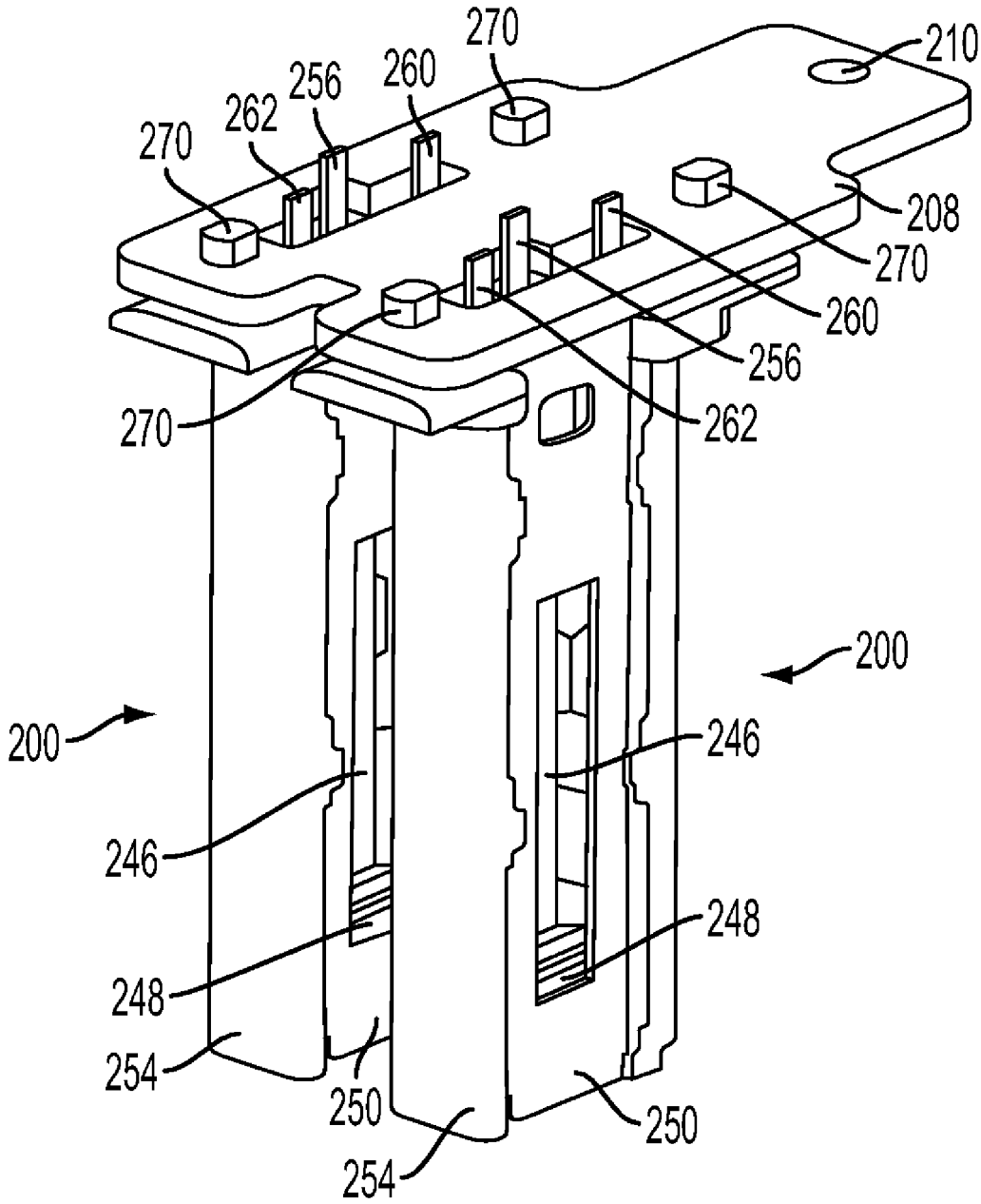
FIG. 11 is a perspective view of the pair of level sensors of FIG. 10 without the flex cable.

FIGS. 8 and 9 show the ink storage and supply system 400 with the ink collector removed showing the reservoirs 404 and corresponding ink level sensors 200 of the present disclosure. In particular, FIG. 8 shows the ink level sensors 200 positioned in each of the reservoirs 404 of the ink storage and supply system 400, and FIG. 9 shows the ink level sensors 200 removed from the corresponding reservoirs 404 for clarity. In the dual reservoir system of FIG. 6, ink level sensors 200 may be provided in the primary reservoirs 408 of the ink storage and supply system 400.

Level sensor positioning support members 208 are operably connected to the level sensors 200 and the ink storage and supply system 400 to locate or position the level sensors in their respective reservoirs 404. As depicted in FIGS. 8-11, a single support member 208 may be used to support two level sensors 200 in adjacent reservoirs (for a total of two support members in the exemplary embodiment). A separate support member, however, may be provided for each level sensor. The support members 208 may be formed of any suitable material capable of supporting the level sensors, such as plastic, and may include features that enable the support members to be secured, fixedly or removably, to ink storage and supply system. For example, the support members may include fastener openings 210 that are configured to receive a fastener, such as a screw or bolt, therethrough and into a corresponding fastener opening (not shown) in the ink storage and supply system. The support members also include appropriate features (explained below) that enable the level sensors to be secured, fixedly or removably, to the support members.

Referring now to FIGS. 12-15, there is shown an embodiment of a level sensor 200. The level sensor 200 includes a body that is configured for insertion into an ink reservoir so that a bottom or lower portion of the sensor is at or near a bottom of the reservoir with the top portion of the sensor at or above the top of the reservoir. The level sensor of FIGS. 12-15 includes a lower probe 248, an upper probe 246, and an outer probe 250 that are supported by an insulating probe support frame 254. The insulating probe support 254 is configured to fixedly position the lower probe 248, upper probe 246, and outer probe 250 relative to each other to ensure that the lower probe, upper probe, and outer probe are physically and electrically isolated from each other. As used herein, a 'probe' shall be defined as any passive or active circuit element or combination of elements that emits or causes there to be emitted a recognizable signal when the probe is in contact with, or otherwise detects the presence of, a liquid. Such probes may rely on optical effects, changes in conductivity, changes in temperature, or any other physical manifestation of the presence of a liquid.

Figure 12:
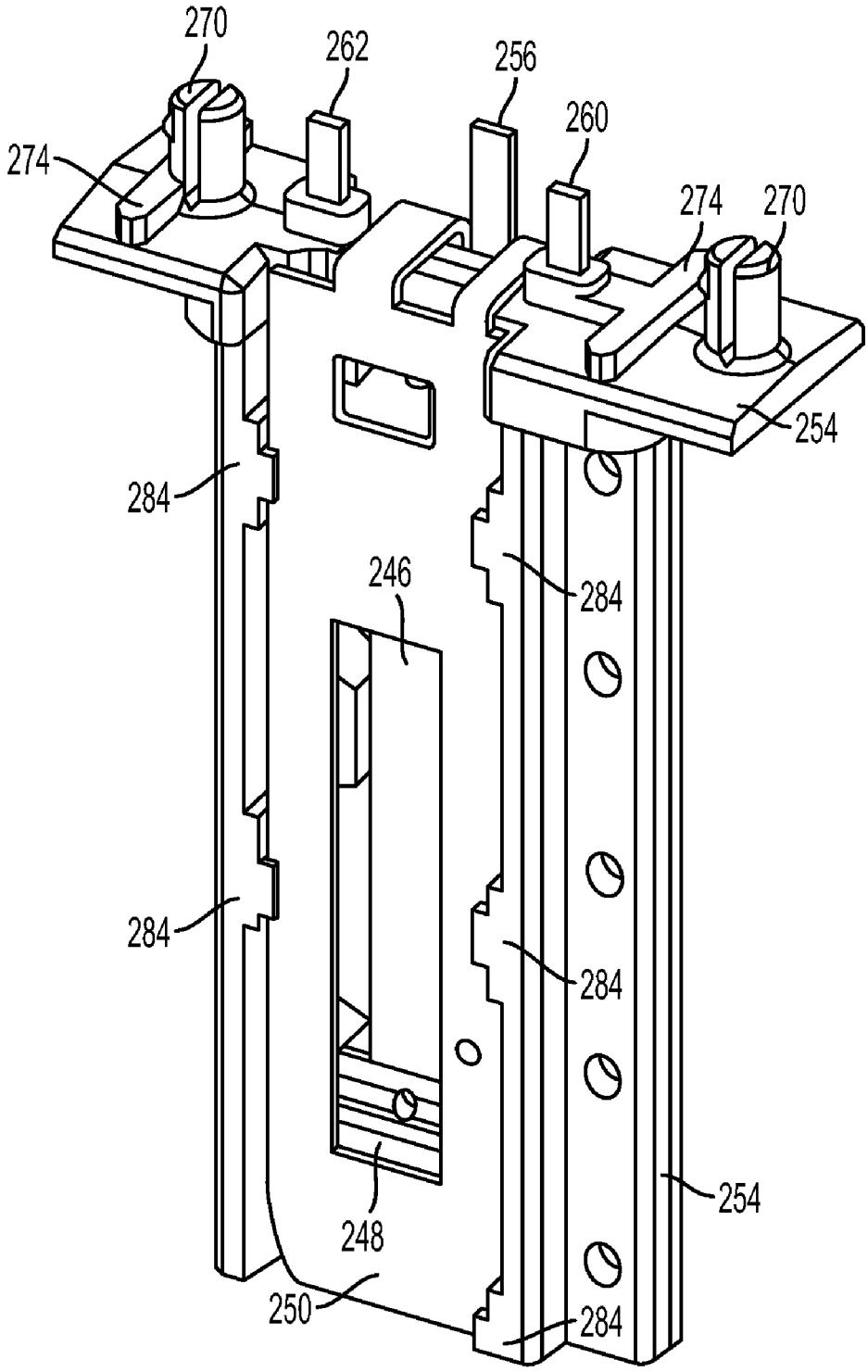
FIG. 12 is a perspective view of a level sensor.
Figure 13:
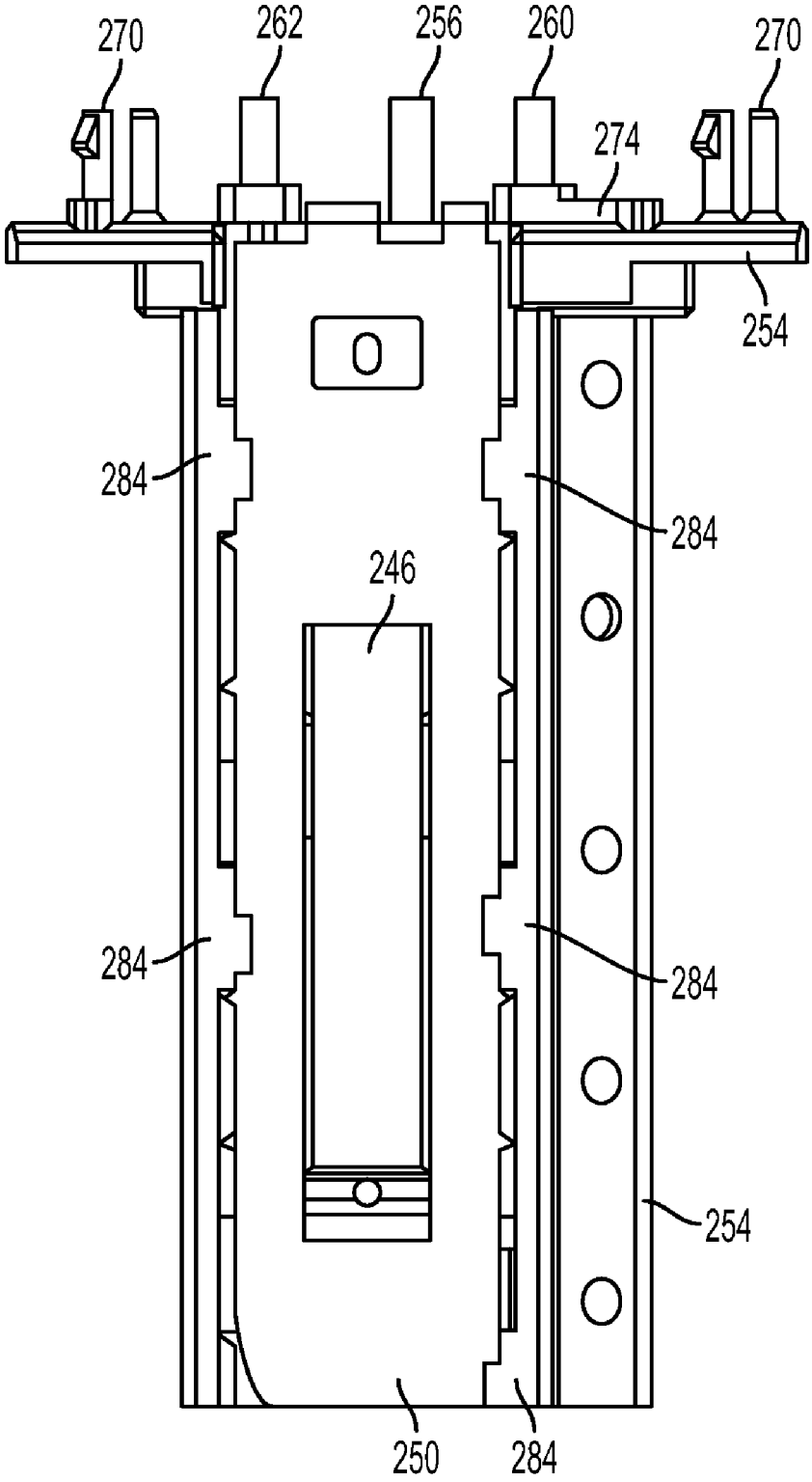
FIG. 13 is a front elevational view of the level sensor of FIG. 12.
Figure 14:
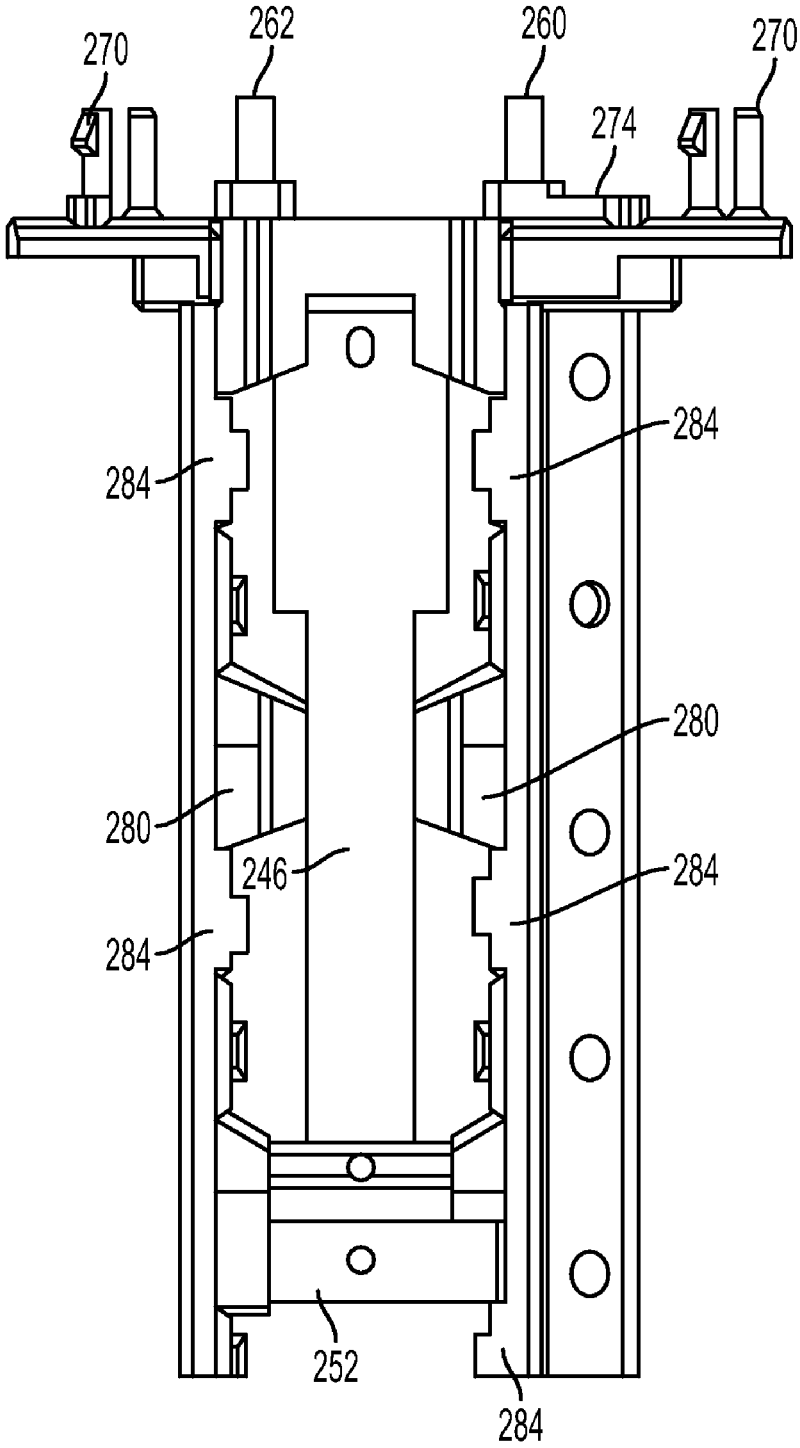
FIG. 14 is a front elevational view of the level sensor of FIG. 12 with the outer probe removed.

The probe support 254 may be formed of any suitable material that is capable of providing the desired electrically isolating properties, such as a plastic material. As shown in FIGS. 12-14, the support frame 254 may include attachment features that facilitate attachment of the level sensors 200 to the sensor supports 208 that connect the sensors to the reservoirs. For example, in the embodiment of FIGS. 12-14, the probe support 254 includes connection studs 270 and standoffs 274 that enable the level sensors to be fixedly or removably secured to the support member and precisely positioned with respect to the support member so that the tabs 260, 262, 256 of the probes may extend through openings in the support members for connection to a signal transmitting/receiving member.

The lower 248 and upper probe 246 of each level sensor 200 may be made integral with the support frame by positioning the lower and upper probes in predetermined positions with respect to each other in a molding tool having the desired final shape of the insulating support frame and over molding the lower and upper probes in the molding tool with a suitable insulating material such as plastic. The support frame may be molded with suitable features that enable the outer probe to be assembled to the molded frame without using adhesive or additional parts. For example, the probe support frame 254 may include standoffs 280 (best seen in FIG. 14) and opposing tabs 284 that define a slot in the direction of insertion that is configured to receive the outer probe 250 and to position the outer probe 250 with respect to the upper 246 and lower probes 248 to provide a predetermined gap therebetween. The standoffs 280 and opposing tabs 284 may be offset as depicted in FIG. 14 to allow for molding in an injection molding machine.

The gap between the outer probe 250 and the upper 246 and lower probes 248 may be any suitable distance that allows the ink to flow freely between the probes while maximizing signal transmission through the ink from the outer probe to the upper and lower probes. A gap that is too small between the outer probe and the upper and lower probes may cause the ink to move sluggishly between the probes, due to surface tension effects. This sluggish movement, especially as the ink drains off the probe, may cause inaccurate level readings, as the ink between the two probes may be of a higher level than the ink in the reservoir. Any suitable means or method, however, may be used to attach the outer probe to the probe support frame to provide the predetermined gap between the outer probe and the upper and lower probes. Molding the support frame around the upper and lower probes enables accurate and repeatable positioning of the probes relative to one another and to the frame.

Figure 15:
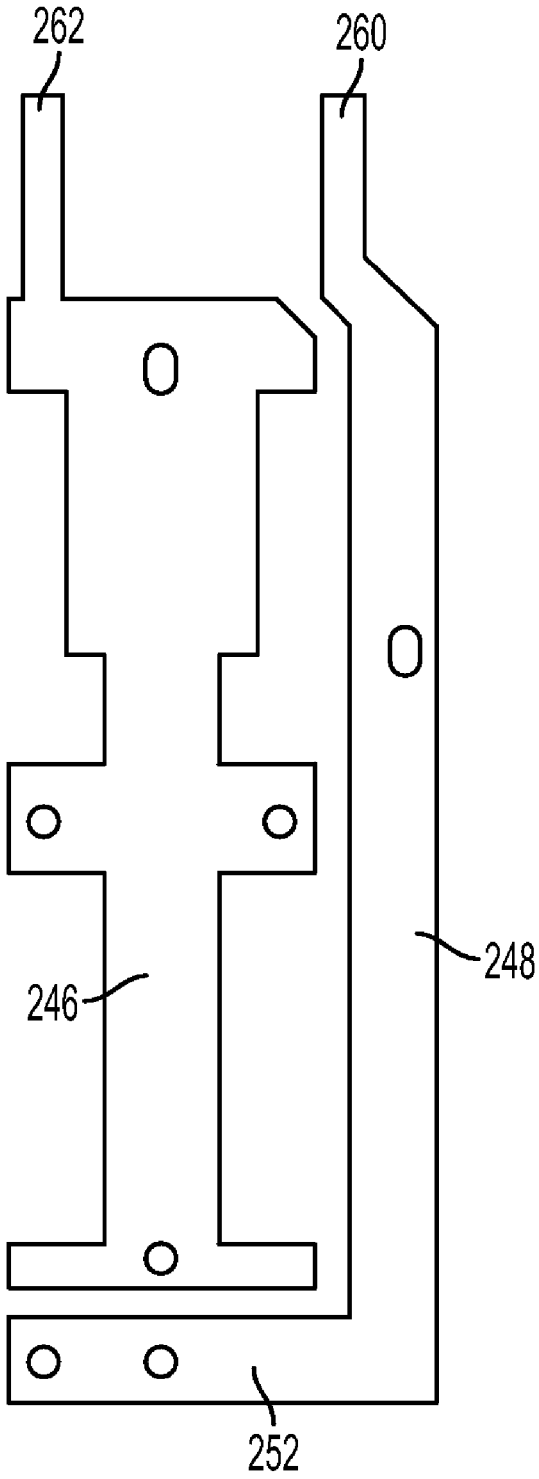
FIG. 15 is a front elevational view of the upper and lower probes of the level sensor of FIG. 12.

FIG. 15 best shows the spatial relationship of the lower probe 248 and upper probe 246 with respect to each other in the support frame (not shown in FIG. 5). As seen in FIG. 15, the lower probe 248 includes a lower portion 252 that is configured to extend to the bottom portion of the level sensor 200 below the upper probe 248 so that the lower portion 252 of the lower probe is positioned at or near the bottom of an ink reservoir when the level sensor is inserted into the reservoir. The upper probe 246 is positioned above the portion 252 of the lower probe 248 and extends to an upper portion of the probe support. As seen in FIGS. 12-14, the outer probe 250 is positioned on the probe support 254 so that it extends substantially from the bottom to the top of the probe support frame 254 alongside both the lower probe 248 and the upper probe 246.

Each of the upper 246, lower 248, and outer probes 250 of each ink level sensor 200 is operably connected to an ink level controller 204. The ink level controller 204 may be implemented in the circuit board 210, or alternatively, may be in communication with the circuit board 210 via a suitable connection device such as a pin connector (not shown). Each of the upper 246, lower 248, and outer probes 250 includes a connection point, or tab, that extends upward through the top portion of the insulating support assembly for connection to the signal transmitting/receiving member. For example, the outer probe includes tab 256, lower probe includes tab 260, and upper probe includes tab 262 that each extends upward through the top portion of the probe support. The tabs of the probes of the level sensors are operably coupled to the circuit board via a suitable signal transmitting/receiving member. The signal transmitting/receiving members may comprise any suitable device or method that enables signal transmission between the probes of the level sensors and the ink level controller.

As depicted in FIGS. 4, 5, and 8-10, the signal transmitting/receiving members 214 comprise flexible circuit members, referred to herein as flex cable, that include probe traces that extend between and electrically connects the circuit board 210 and the respective tabs of the probes of the level sensors. In the embodiment of FIGS. 8-11 in which two level sensors 200 are supported in adjacent reservoirs by a single support member 208, a single flex cable 214 may be utilized to route the input and output signals between the two level sensors 200 and the circuit board 210. The flex cable 214 includes connection points 218 for electrically connecting the probe traces of the flex cable to the appropriate probe tabs. The probe tabs may be connected to the connection points on the flex cable in any suitable manner, such as by soldering. The probe traces include input signal traces 220 that extend between the tabs 256 of the outer probes 250 of the level sensors and the circuit board 210 and output signal traces 224 extending between the tabs 260, 262 of the upper and lower probes of the level sensors and the circuit board 210. The flex cable 214 includes ground traces 228 between the input signal traces and the output signal traces. The ground traces shunt any leakage currents on the flex cable 214 directly to ground such that no leakage current flows from an outer probe trace to an upper or lower probe trace. Although a flex cable with signal traces is shown, other means for transmitting signals to and from the ink level sensors may be utilized including wires, coaxial cables or wireless transmitters and receivers.

To detect the level of ink in an ink reservoir, an AC signal 230 is driven, or input to the tab 256 of the outer probe 250. The ink 290 conducts the AC signal to the lower probe 248 and to the upper probe 246. Controller 204 shown in FIG. 16 detects a current flow from the outer probe 250 through the ink 290 to the lower probe 248. Controller 204 also detects a current flow from the outer probe 250 through the ink 290 to the upper probe 246. Assuming that the ink temperature and conductivity remains relatively consistent, a substantially constant current flow is detected via the lower probe 248. Varying levels of current flow are detected via the upper probe 246 as more or less of the upper probe's surface area is covered or uncovered in ink. The controller 204 is configured to calculate the ratio of the varying current flow in the upper probe 246 to the constant current flow of the lower probe 248 resulting in a continuous measurement of the height of ink in the ink reservoir.

Figure 16:
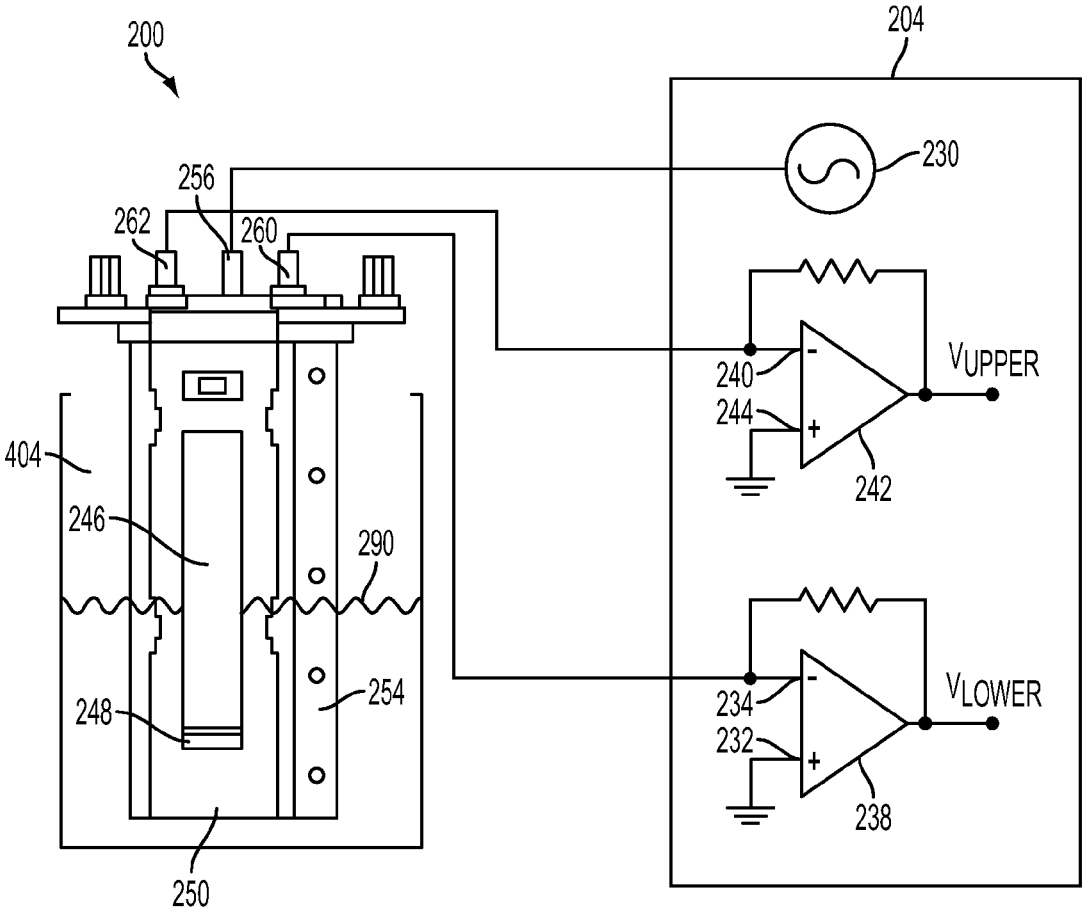
FIG. 16 is a simplified schematic and circuit diagram of an ink level sensor and ink level controller.

As depicted in FIG. 16, the lower probe 248 is electrically connected to the negative input 234 of op/amp 238 in controller 204. This negative input 234 forms a virtual ground by connecting the positive input 232 of op/amp 234 to ground and also connecting the negative input 234 of op/amp 238 through a resistor to the output of op/amp 238. This virtual ground circuit eliminates any stray currents that can arise due to conductivity from the probes and associated traces and wires to electrical ground (i.e., reservoir body and other metal structures). Responsive to the current flow from the outer probe 250 through the ink 290 to lower probe 248, op/amp 238 outputs a voltage $V_{lower}$ that is an expression of a conductance of the ink 290 in the reservoir 404. The conductance is measured for substantially any level of ink 290 in the reservoir 404 because the lower probe 248 is positioned near the bottom of the reservoir 404.

The upper probe 246 is electrically connected to the negative input 240 of op/amp 242 in controller 204. This negative input 240 forms a virtual ground by connecting the positive input 244 of op/amp 242 to ground and also connecting the negative input 240 of op/amp 242 through a resistor to the output of the op/amp 242. This virtual ground circuit eliminates any stray currents that can arise due to conductivity from the probes and associated traces and wires to electrical ground (i.e., reservoir body and other metal structures). Responsive to the current flow from the outer probe 250 through the ink 290 to upper probe 246, op/amp 242 outputs a voltage $V_{upper}$ that is an expression of a conductance of the ink 290 contacting the surface area of the upper probe 246. As the level of the ink 290 varies in reservoir 40, that amount of surface area of upper probe 246 immersed in the ink 290 varies resulting in a varying conductance.

The controller 204 calculates the ratio of the variable $V_{upper}$ to the base value of $V_{lower}$. The ratio calculation can be accomplished by connecting the outputs of the virtually grounding op/amps 242, 238 to analog-to-digital converters (not shown) and dividing the two digital values within controller 204. Any other methods of calculating ratios of voltages commonly known in the art are contemplated to be within the scope of this disclosure. This ratio gives a continuous measurement of the level of ink 290 in reservoir 404. The conductance of ink varies over types of inks and even within the same type of ink at different temperatures. The two probes 246, 248, along with virtually grounding op/amps 242, 238, and controller 204, result in a ratio of two conductivities. Thus, no matter what type of ink or what temperature the ink, within the physical limitations imposed by components such as the resistors, a ratio of conductance is measured which correlates to ink fluid level within the reservoir chamber.

Phase change ink printers including the level sensors above are typically optimized for use with ink having a particular conductivity or having conductivity within a nominal range. Phase change inks of different formulations, including color, typically have unique inherent conductivities. Therefore, contaminated ink including ink having a color or formulation not intended for use with a particular reservoir or batches of ink with extreme conductivity may cause the conductivity of the ink volume in one or more of the reservoirs to vary beyond a range that is acceptable to performance when that conductivity is used. Due to variation inherent in the manufacture of ink from raw components, a moderate variation in the conductivity of the ink may be expected from batch to batch and accounted for accordingly. For example, the level sensor described above may be considered to functioning accurately so long as the ink conductivity detected by the lower probe remains within a nominal range. The nominal range may be predetermined and corresponds to the range of ink conductivity at which the ink level sensors described above may be considered to be functioning accurately. If ink having a conductivity that exceeds the range of reliable operation of a level sensor enters the reservoir, the level readings generated by the level sensor for that reservoir may not be accurate or the level sensor may fail altogether resulting in various printhead failures, including introduction of air which causes jetting failure, and weeping of jets which can contaminate the drum.

In response to the difficulties posed due to contaminated ink, an ink recovery operation mode has been developed that enables the restoration of ink conductivity of a reservoir ink volume to a nominal range of operational conductivity in response to the ink conductivity being outside of the nominal range. As described above, the present system is configured to monitor the ink conductivity of the ink in the reservoirs during the level sensing process. In one embodiment, the ink recovery operation mode involves monitoring the conductivities of the ink volumes in the melt reservoirs and to determine when the ink is contaminated, i.e., has a conductivity that exceeds the operational range of the level sensor in the reservoirs. The operational range may be any suitable range of ink conductivities at which the level sensor is capable of providing substantially accurate level readings. Due to the ink conductivity differences that may be exhibited by inks of different colors or shades, the operational range for a given melt reservoir may be different than the operational ranges for the other melt reservoirs. When it is determined that the ink conductivity of the ink volume in a reservoir is outside of the operational range of ink conductivity for the level sensor of the reservoir, the reservoir is considered contaminated and a flush routine is initiated that involves emptying and refilling the contaminated reservoir until the contaminant is no longer present in the reservoir in debilitating amounts.

In one embodiment, the ink recovery operation mode is implemented as a software controlled algorithm in the controller. The control software is configured to recognize a contamination event by monitoring a nominal ink conductivity sensor positioned in each melt reservoir in the imaging device. As mentioned above, the lower probe of the level sensor assemblies described above may be used to detect the ink conductivity of the ink volume in the melt reservoirs. Accordingly, in one embodiment, the nominal ink conductivity sensor for a melt reservoir corresponds to the lower probe of the level sense probe assembly for the reservoir. However, a conductivity probe or sensor other than the ink level sensors described above may be utilized.

The control software is configured to compare the ink conductivity levels indicated by the nominal ink conductivity sensors for the melt reservoirs to a nominal operational value or value range for the level sensors of the melt reservoirs. The comparison of the ink conductivity level of a melt reservoir may be performed at any suitable frequency. In one embodiment, the control software is configured to compare the ink conductivity level of the ink volume in a melt reservoir to the nominal operational value or value range at a frequency of approximately 2.5 Hz although any suitable frequency may be used.

The control software recognizes a contamination event if the monitored ink conductivity of an ink volume in a melt reservoir exceeds or falls below the nominal operational value or value range. The control software may also be configured to compare the monitored ink conductivities of ink volumes in the melt reservoirs to minimum and maximum threshold values. Detected ink conductivity levels that fall below the minimum or exceed the maximum threshold values may be indicative of a fault condition that may not be correctable by flushing the ink from the reservoirs and that may require maintenance that goes beyond the capabilities of the maintenance system of the imaging device. If the control software determines that the ink conductivity level of a melt reservoir falls below the minimum or exceeds the maximum threshold value, the control software may be configured to disable print operations and alert a user that a fault has occurred and that a service call may be required.

The control software may also be configured to recognize a contamination event in response to the rate of change of the ink conductivity of the ink volume in a melt reservoir exceeding a predetermined operational rate of change. For example, the controller may be configured to determine a rate of change of the ink conductivity for the ink volume in a melt reservoir by comparing current ink conductivity readings of an ink volume in a melt reservoir to previous ink conductivity readings for the ink volume. The control software may then be configured to compare the determined rate of ink conductivity change for a melt reservoir to a predetermined rate or rate range of ink conductivity change. The control software may be configured to recognize a contamination event if the monitored ink conductivity change rate of a melt reservoir exceeds or falls below the predetermined rate or rate range.

In response to the recognition of a contamination event, the control software is configured to cause the system to enter a flush mode. In the flush mode, a flush routine is implemented in which printing and ink supply operations are stopped or disabled, and the maintenance system is activated to purge ink through the printheads to the waste tray. Purging ink through the printheads while the ink supply is disabled acts to empty or flush the ink from the melt reservoirs. Ink supply operations may then be enabled so that the emptied or flushed melt reservoir may be refilled with ink. The control software may then determine whether the ink conductivity of the ink volume in a melt reservoir has returned to the nominal operational range or if the ink conductivity is still outside of the operational range at which point the process may be repeated. The flush routine may be repeated any suitable number of times. If, however, the detected ink conductivity of ink in a melt reservoir has not returned to the nominal operational range after a predetermined number of flush routines, the control software may be configured to recognize a fault condition and disable print operations and alert a user that a fault has occurred and that a service call may be required. For example, in one embodiment, the control software may be configured to declare a fault if the conductivity of the ink has not returned to the normal operational range after the melt reservoir has been flushed and refilled three times.

In one embodiment, the flush routine is operated in an open loop scenario in which no feedback is given via the melt reservoir level sensors. Accordingly, in the flush mode, the initiating of melt cycles to supply melted ink to the reservoirs in response to detected ink levels is disabled. Instead, level sensors in the printheads are used to monitor the presence of ink, or lack thereof, in the printheads. Accordingly, in the flush mode, the printheads are purged which empties the printheads of ink. The melt reservoir then supplies ink to the printheads until the printhead level sensor indicates that the printhead has been refilled. Once full, the printheads are once again emptied by purging. This process, also referred to as flushing the printhead, is repeated until the printhead level sensors do not register the presence of ink in the printhead after the printhead has had a chance to be refilled. When the printhead level sensors indicates that no ink is present in the printhead, the melt reservoir may be considered to be emptied at which point the ink supply and level sense may be enabled. Accordingly, a melt duty cycle is initiated in which the melt plates are heated up and melted ink is supplied into the melt reservoir until the reservoir level sensor indicates that the melt reservoir is full, or a timer has expired, whichever comes first. The conductivity of the ink volume supplied to the melt reservoir may then be detected and compared to the predetermined nominal ink conductivity or conductivity range to determine if the ink conductivity has returned to normal operational values. If the detected ink conductivity of the melt reservoir indicates that the ink conductivity again falls below or exceeds the nominal ink conductivity range, the process described above may be repeated.

Figure 17:
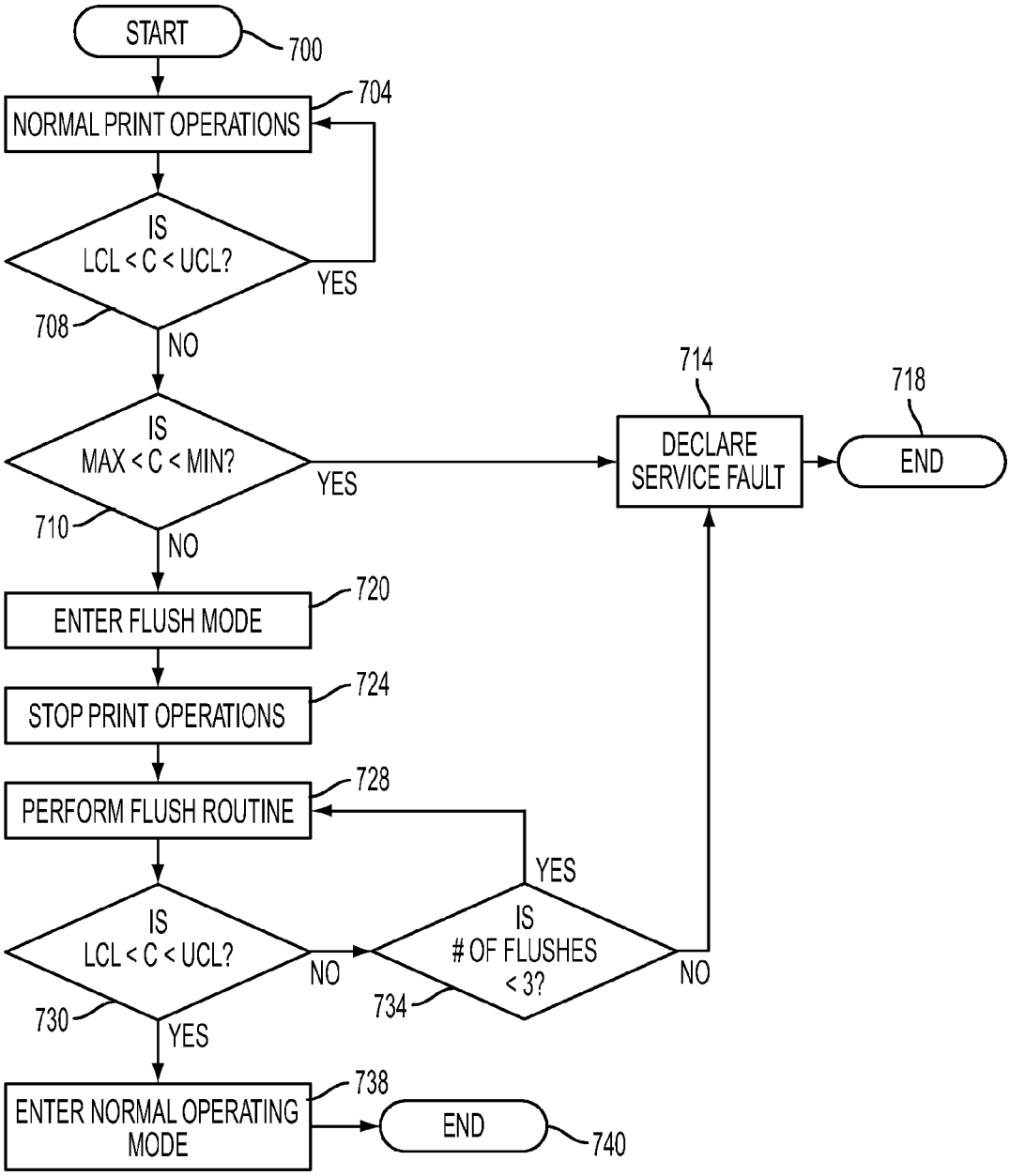
FIG. 17 is a flow chart showing an algorithm for restoring ink conductivity of a contaminated ink reservoir to a nominal operational range.

Referring now to FIG. 17, there is shown a flow chart of a software controlled algorithm for the flush routine described above. As mentioned, the control software is configured to monitor the ink conductivities of the ink volumes in the melt reservoirs indicated by the nominal ink conductivity sensors for the melt reservoirs. According to the flow chart, the ink conductivity of the ink volume in a reservoir is compared to an upper conductivity operational limit (UCL) and a lower conductivity operational limit (LCL) to determine if the ink conductivity is within the operational limits of the level sensor in the melt reservoir (block 708). If the ink conductivity is within the operational range defined by the upper and lower limits, control returns to block 704 and normal printing operations are continued. If the detected ink conductivity is not within the operational range defined by the upper and lower limits, control passes to block 710 at which the ink conductivity is compared to a minimum and a maximum threshold value. If the ink conductivity falls below the minimum threshold value or exceeds the maximum threshold value, control passes to block 714 at which a fault is declared and the algorithm ends (block 718). If the detected ink conductivity is between the minimum and maximum threshold values, the flush mode is entered (block 720). As described above, in the flush mode, printing operations are halted (block 724) and a flush routine is performed (block 728) to empty the melt reservoir of contaminated ink and to refill the melt reservoir with new ink. The detected conductivity of the ink in the refilled melt reservoir is then compared again to the upper and lower operational limits (block 730). If the ink conductivity is not within the normal operational range, the flush routine may be performed again until a predetermined number of flush routines, in this case three, have been performed and the ink conductivity still has not returned to the normal operational range (block 734) at which point a service fault may be declared (block 714) and the algorithm ends. If the ink conductivity of the refilled melt reservoir is within the normal operational range, the printer may be returned to normal operating mode and commence printing operations (block 738). There may be a control requirement based on the amount of time the sensors have reported the conductivity of the ink to be within the operational range, and this may be a requirement which needs to be met before returning to normal operating mode.

Those skilled in the art will recognize that numerous modifications can be made to the specific implementations of the ink conductivity recovery methods described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of using an ink reservoir of an imaging device, the method comprising:

measuring an ink conductivity of an ink volume in an ink reservoir of an imaging device, the ink reservoir being configured to receive ink from an ink supply and to deliver the received ink to at least one printhead of the imaging device;

comparing the measured ink conductivity to a predetermined ink conductivity operational range;

in response to the measured ink conductivity being below or exceeding the predetermined ink conductivity operational range, performing a flush routine that includes:

disabling ink supply operations to the ink reservoir;

emptying the ink reservoir of ink;

refilling the ink reservoir with ink;

measuring an ink conductivity of an ink volume in the refilled ink reservoir;

comparing the detected ink conductivity to the predetermined ink conductivity operational range;

in response to the measured ink conductivity being within the predetermined ink conductivity operational range after a flush routine has been performed, returning the imaging device to a normal operating mode.

2. The method of claim 1, further comprising:

in response to the measured ink conductivity being below or above the predetermined ink conductivity operational range after a flush routine has been performed, repeating the flush routine until the detected ink conductivity is within the predetermined ink conductivity operational range or a predetermined number of flush routines have been performed.

3. The method of claim 2, further comprising:

in response to the predetermined number of flush routines being performed and the detected ink conductivity not returning to the predetermined ink conductivity operational range, generating a user recognizable alert.

4. The method of claim 3, further comprising:

prior to performing a flush routine, comparing the detected ink conductivity to a minimum and a maximum threshold value;

in response to the detected ink conductivity being below the minimum threshold value or exceeding the maximum threshold value, generating a user recognizable alert.

5. The method of claim 3, the emptying of ink from the ink reservoir further comprising:

purging ink through the at least one printhead and supplying remaining ink in the ink reservoir to the printhead until the ink reservoir is empty of ink.

6. The method of claim 5, the purging of the ink further comprising:

purging ink through the at least one printhead until the printhead is empty of ink;

refilling the printhead with ink from the ink reservoir; and repeating the purging and refilling steps until the ink reservoir is empty of ink.

7. The method of claim 1, the measuring of the ink conductivity further comprising:

monitoring the ink conductivity using a first probe of an ink level sensor having two probes in the ink reservoir, the first probe being positioned near a bottom of the ink reservoir and configured to generate a signal indicative of the ink conductivity of the ink volume in the ink reservoir.

8. The method of claim 1, the measuring of the ink conductivity and the comparison of the ink conductivity being performed at a predetermined frequency.

9. The method of claim 8, the predetermined frequency comprising 2.5 Hz.

10. The method of claim 1, the detection of the ink conductivity further comprising:

measuring an ink conductivity of an ink volume in each ink reservoir in a plurality of ink reservoirs of an imaging device, each of the ink reservoirs being configured to receive a different ink from the ink supply and to deliver the received ink to at least one printhead of the imaging device.

11. The method of claim 10, the comparison of the measured ink conductivity further comprising:

comparing the measured ink conductivity for each of the ink reservoirs to a predetermined ink conductivity operational range for each ink reservoir.

12. A system for use with an imaging device, the system comprising:

at least one ink reservoir configured to hold a volume of ink and to communicate ink to at least one printhead;

an ink conductivity sensor positioned in the at least one ink reservoir, the ink conductivity sensor being configured to generate at least one signal indicative of an ink conductivity of a volume of ink in the at least one ink reservoir;

a controller configured to receive the at least one signal from the ink conductivity sensor and to compare the ink conductivity indicated by the signal to a predetermined ink conductivity operational range, the controller being configured to implement a flush routine in response to the ink conductivity in the at least one ink reservoir being outside of the predetermined ink conductivity operational range, the flush routine including:

disabling ink supply operations to the ink reservoir;

emptying the ink reservoir of ink;

refilling the ink reservoir with ink;

measuring an ink conductivity of an ink volume in the refilled ink reservoir;

comparing the detected ink conductivity to the predetermined ink conductivity operational range;

in response to the detected ink conductivity being within the predetermined ink conductivity operational range after a flush routine has been performed, the controller being configured to return the imaging device to normal operating mode.

13. The system of claim 12, the controller being configured to repeat the flush routine until the detected ink conductivity is within the predetermined ink conductivity operational range or a predetermined number of flush routines have been performed in response to the detected ink conductivity being below or above the predetermined ink conductivity operational range after a flush routine has been performed.

14. The system of claim 13, the controller being configured to generate a service fault in response to the predetermined number of flush routines being performed and the detected ink conductivity not returning to the predetermined ink conductivity operational range.

15. The system of claim 12, the ink conductivity sensor comprising a first probe of an ink level sensor having two probes in the ink reservoir.

16. The system of claim 15, the ink conductivity sensor being configured to generate a signal indicative of an ink conductivity of a volume of melted phase change ink in the ink reservoir.

17. The system of claim 12, the ink conductivity sensor further comprising:

a separate ink conductivity sensor positioned in each of a plurality of ink reservoirs of the imaging device, each ink reservoir being configured to hold a different ink, each of the ink conductivity sensors being configured to generate a signal indicative of the ink conductivity of the ink volume in the corresponding ink reservoir.

18. The system of claim 17, the controller being configured to compare the ink conductivity of a respective ink reservoir to a predetermined ink conductivity operational range for the respective ink reservoir, the controller being configured to implement the flush routine for the respective ink reservoir in response to the ink conductivity being outside of the predetermined ink conductivity operational range for the respective ink reservoir.

19. A method of operating an imaging device, the method comprising:

measuring an ink conductivity of an ink volume in an ink reservoir of an imaging device, the ink reservoir being configured to receive ink from an ink supply and to deliver the received ink to at least one printhead of the imaging device;

comparing the measured ink conductivity to a predetermined ink conductivity operational range;

disabling print operations of the imaging device and ink supply operations to the ink reservoir in response to the measured ink conductivity being outside of the predetermined ink conductivity operational range;

purging ink through the at least one printhead until the printhead is empty of ink;

refilling the printhead with ink from the ink reservoir;

repeating the purging and refilling steps until the ink reservoir is empty of ink;

enabling ink supply operations to the ink reservoir from the ink supply to refill the ink reservoir in response to the ink reservoir being emptied;

measuring an ink conductivity of an ink volume in the refilled ink reservoir;

comparing the measured ink conductivity to the predetermined ink conductivity operational range; and enabling print operations in response to the measured ink conductivity being within the predetermined ink conductivity operational after the ink reservoir has been refilled.

20. The method of claim 19, further comprising:

purging ink through the at least one printhead and supplying ink from the ink reservoir until the ink reservoir is empty in response to the measured ink conductivity being outside of the predetermined ink conductivity operational range after the ink reservoir has been refilled.

* * * * *